US006701709B2

(12) United States Patent
Isaac, Jr. et al.

(10) Patent No.: US 6,701,709 B2
(45) Date of Patent: Mar. 9, 2004

(54) CYLINDRICAL CAM STIRLING ENGINE DRIVE

(75) Inventors: Donald Isaac, Jr., Half Moon Bay, CA (US); Alphonse Vassallo, San Francisco, CA (US); Ronald J. Steele, Scappoose, OR (US)

(73) Assignee: Tamin Enterprises, Half Moon Bay, CA (US)

( * ) Notice: Subject to any disclaimer, the term of this patent is extended or adjusted under 35 U.S.C. 154(b) by 0 days.

(21) Appl. No.: 10/222,610

(22) Filed: Aug. 16, 2002

(65) Prior Publication Data

US 2003/0046932 A1 Mar. 13, 2003

Related U.S. Application Data

(60) Provisional application No. 60/313,309, filed on Aug. 18, 2001.

(51) Int. Cl.[7] ..... F01B 29/10
(52) U.S. Cl. ..... 60/517; 60/525
(58) Field of Search ..... 60/517, 525, 526

(56) References Cited

U.S. PATENT DOCUMENTS

| | | | | | |
|---|---|---|---|---|---|
| 2,475,770 | A | | 7/1949 | Wijsman | |
| 3,385,051 | A | | 5/1968 | Kelly | 60/24 |
| 4,057,040 | A | * | 11/1977 | Wax | 123/46 R |
| 4,413,474 | A | * | 11/1983 | Moscrip | 60/517 |
| 4,455,825 | A | * | 6/1984 | Pinto | 60/517 |
| 4,996,953 | A | | 3/1991 | Buck | 123/58 |
| 5,095,700 | A | * | 3/1992 | Bolger | 60/517 |
| 5,442,913 | A | | 8/1995 | Cho et al. | 60/518 |
| 5,533,335 | A | | 7/1996 | Shin | 60/517 |

* cited by examiner

*Primary Examiner*—Hoang Nguyen
(74) *Attorney, Agent, or Firm*—Gordon & Jacobson, P.C.

(57) ABSTRACT

A Stirling engine includes a grooved cam drive mechanism with followers having a pair of longitudinally displaced bearings. One roller bearing is adapted to ride along an upper surface of the cam groove, while the other roller bearing is adapted to ride along a lower surface of the cam groove. Each follower includes an outer shaft on which a first bearing is mounted, and an inner shaft extending through the outer shaft on which a second bearing is mounted. A preferably annular space is provided between the inner and outer shafts when the follower is in an unloaded state. Then, when the follower is engaged within the grooved cam, the inner shaft is cantilevered relative to outer shaft within the annular space and results in pre-loading the first bearing against one inner surface of the groove cam and the second bearing against an opposite inner surface of the grooved cam.

24 Claims, 8 Drawing Sheets

CYLINDRICAL CAM STIRLING ENGINE DRIVE

This application claims the benefit of U.S. Provisional Application No. 60/313,309, filed Aug. 18, 2001, which is hereby incorporated by reference herein in its entirety.

BACKGROUND OF THE INVENTION

1. Field of the Invention

This invention relates broadly to a Stirling engine. More particularly, this invention relates to a cam drive system for a Stirling engine that converts linear mechanical motion of pistons into rotary motion at an output shaft and vice versa.

2. State of the Art

Stirling engines are heat engines that operate on a closed thermodynamic cycle to convert heat energy into mechanical energy by alternately compressing and expanding a confined working fluid (gas or liquid). As with any heat engine, the engine requires a hot sink and a cold sink and, in the Stirling engine, the confined working fluid is externally heated and cooled. Unlike a steam engine, the working fluid does not change phase at anytime during the thermodynamic cycle. The alternate heating and cooling of the working fluid produces an alternating pressure within the engine. The alternating pressure (or pressure wave) can be converted to mechanical power by several means. For example, the pressure wave can act on pistons, bellows, or diaphragms to convert the pressure wave into mechanical power. Pistons, bellows, and diaphragms produce linear motion that must be converted to rotary motion where rotary motion engine output is desired.

There are a number ways to accomplish the conversion of linear motion from the piston into rotary motion. Crankshafts, wobble-plates, swash-plates, cams, and various other means have been used in the past.

Theories claim Stirling engine performance can be improved by causing a displacer of the engine to dwell at top dead center and bottom dead center. By dwelling at these positions, the working fluid remains in a heat exchanger of the engine for a longer time resulting in greater energy transfer to or from the walls of the heat exchanger to or from the working fluid. Dwells in motion are relatively easy with cams as compared with other mechanisms such as cranks, wobble-plates, and swash-plates that inherently produce sinusoidal or nearly sinusoidal motion. The cam followers engaging the cams can either be sliding or rolling.

High-speed cam design requires attention to the first three derivatives of the displacement function: velocity, acceleration, and jerk. The displacement required is defined by the piston stroke. The shape of the cam curve with respect to rotation is made up of intervals of rise, fall, and dwell. During dwell, there is no piston motion as the cam rotates. The intervals are designed and pieced together so that there preferably are never infinite or excessively high values of acceleration and/or jerk. By controlling acceleration and jerk, the forces on a cam follower and associated moving components can be kept to acceptable levels. This also reduces wear, spalling, and friction on the followers and cam surface in contact with the follower.

Except at very low speeds, sliding cam followers require copious lubrication to maintain a hydrodynamic barrier between the follower and cam surface. Lubrication can be achieved by submersion or pump flooding the cam/follower contact area. The follower rides on a thin hydrodynamic layer of lubricant that reduces friction, prevents high speed contact, and carries away heat that may be generated. However, at high speeds, sliding cam followers require a crankcase containing a fluid lubricant such as oil or grease (wet sump).

Rolling followers can also be used, but have other problems. U.S. Pat. No. 4,996,953 to Buck describes a grooved cam system for a Stirling engine. When the direction of follower load reverses, as it will with double-acting Siemens-type Stirling pistons, the cam follower alternately contacts both sides of the cam groove as the cam rotates. Because the cam rotates in one direction continuously, the rolling follower must reverse direction instantly when switching contact from an upper surface to a lower surface. This reversing may be acceptable for small light weight follower bearings operating at low speeds but large heavy follower bearings rotating at high speeds have considerable inertia and attempting to instantly reverse direction when contacting the opposite surface results in skidding and destruction of the mating follower and cam surfaces.

U.S. Pat. No. 3,385,051 to Kelly teaches a dual blade cam system in which each of two wave-shaped blade cams extends radially outward from the output shaft of the engine. Roller bearings are provided on first and second sides of each of the cams. Blade-type cylindrical cams do not have the problems associated with reversing follower direction of rotation, because for reversing follower loads there are two followers, one above the cam blade, and one below. Each follower is continuously in contact with the same cam surface moving in the same direction. Therefore, there is no skidding. However, these follower assemblies tend to be large, heavy, complex, and expensive. Moreover, unless preloaded, these assemblies can be particularly loud, especially when the load reverses directions and the follower in contact with a cam surface is changed.

Some Stirling engines, such as swash-plate drive engines, operate with wet sumps and require sealing at the piston drive rods to prevent oil from entering the working fluid space from the crankcase fluid space as well as containing the working fluid in the working space. Lubricant in the working fluid can contaminate heat exchanger surfaces or plug the fine pores in the regenerator. Contaminated heat exchangers can reduce performance or cause the engine to be inoperable. Contaminated heat exchangers are difficult or impossible to clean. Explosion in the heater can result if the working fluid is air containing oxygen and the contaminating lubricant is flammable. Because of potential contamination or explosion hazard, and the desire to be able to operate in any orientation, dry-sump Stirling engine designs are desirable.

SUMMARY OF THE INVENTION

It is therefore an object of the invention to provide an improved cam drive mechanism for the conversion of Stirling engine piston linear motion to output shaft rotary motion and vice-versa.

It is another object or the invention to provide for optional cam shapes to produce various cam follower (thus piston) motions (displacement, velocity, acceleration, and dwell) such that the Stirling thermodynamics may be exploited by using optimized piston motions.

It is also an object of the invention to provide a compact Stirling engine mechanical drive that has low volume and weight with respect to traditional Stirling engines.

It is a further object of the invention to provide a high efficiency (low friction) mechanical drive.

It is an additional object of the invention to provide a drive mechanism that is easily manufactured and thus less costly to produce.

It is yet another object of the invention to provide a drive mechanism that is reliable and has low maintenance requirements.

In accord with these objects, which will be discussed in detail below, a Stirling engine is provided having a grooved cam drive mechanism, with cam followers coupled to each piston of the engine and engaged within the grooved cam. Each follower includes a pair of longitudinally displaced bearings. One bearing is adapted to ride along an upper inner surface of the cam, while the other bearing is adapted to ride along a lower inner surface of the cam.

More particularly, each follower includes an outer shaft on which a first of the bearings is mounted, and an inner shaft on which a second of the bearings is mounted. A preferably annular space is provided between the inner and outer shafts when the follower is in an unloaded state. Then, when the follower is engaged within the grooved cam, the inner shaft is cantilevered relative to outer shaft within the annular space and results in pre-loading the first bearing against one inner surface of the groove cam and the second bearing against an opposite inner surface of the grooved cam. The pre-loading eliminates excessive noise and increased bearing wear that would otherwise result.

In accord with one embodiment of the invention, the axes of rotation for the bearings are offset by a first amount in the unloaded state, and a second lesser amount in the loaded state.

In accord with another embodiment, the cam groove has a stepped surface and the bearings of a cam follower have different diameters but a common rotational axis in the unloaded state. When the follower inserted into the groove, the axes of rotation for the bearings are offset, and the larger diameter bearing bears against a surface opposite the step and the smaller diameter bearing bears against a surface of the step.

The bearings are preferably crowned, i.e., have a preferably spherically curved surface. This permits line contact with the cam surface thus reduces the effect of the difference in cam surface velocity at different radial distances from the output shaft rotation centerline. Moreover, the tandem pair of bearings on each follower provide greater load carrying capacity. Furthermore, each bearing is dedicated to rotation in only a single direction.

The cam and followers of the invention provide an engine capable of operating at high speed and low noise. Furthermore, the cam drive mechanism operates with low wear. Moreover, the cam and followers are easily manufactured, and provide a compact, relatively inexpensive, and light weight assembly.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
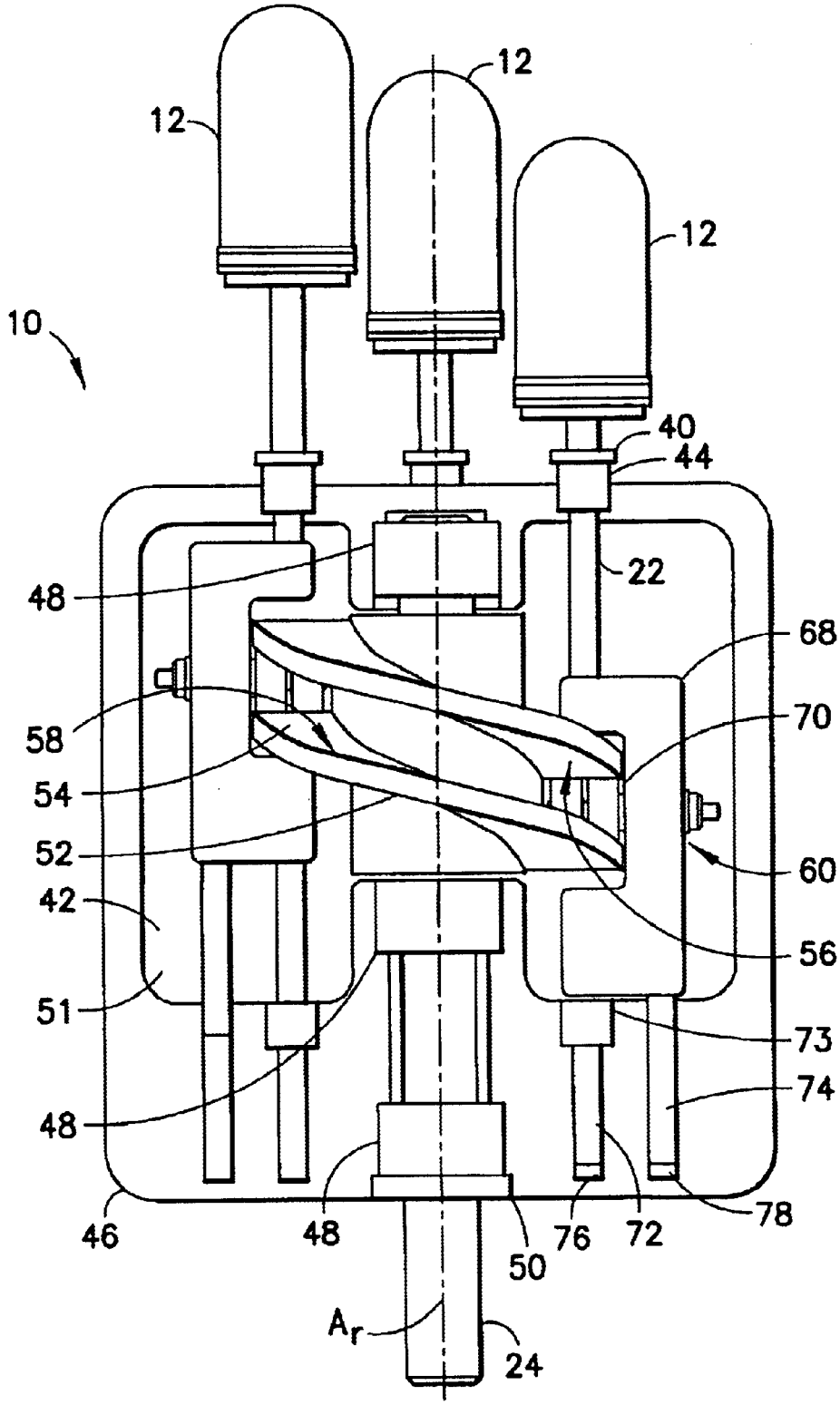
FIG. 1 is a partial cut-away view of a first embodiment of a Stirling engine according to the invention.
Figure 2:
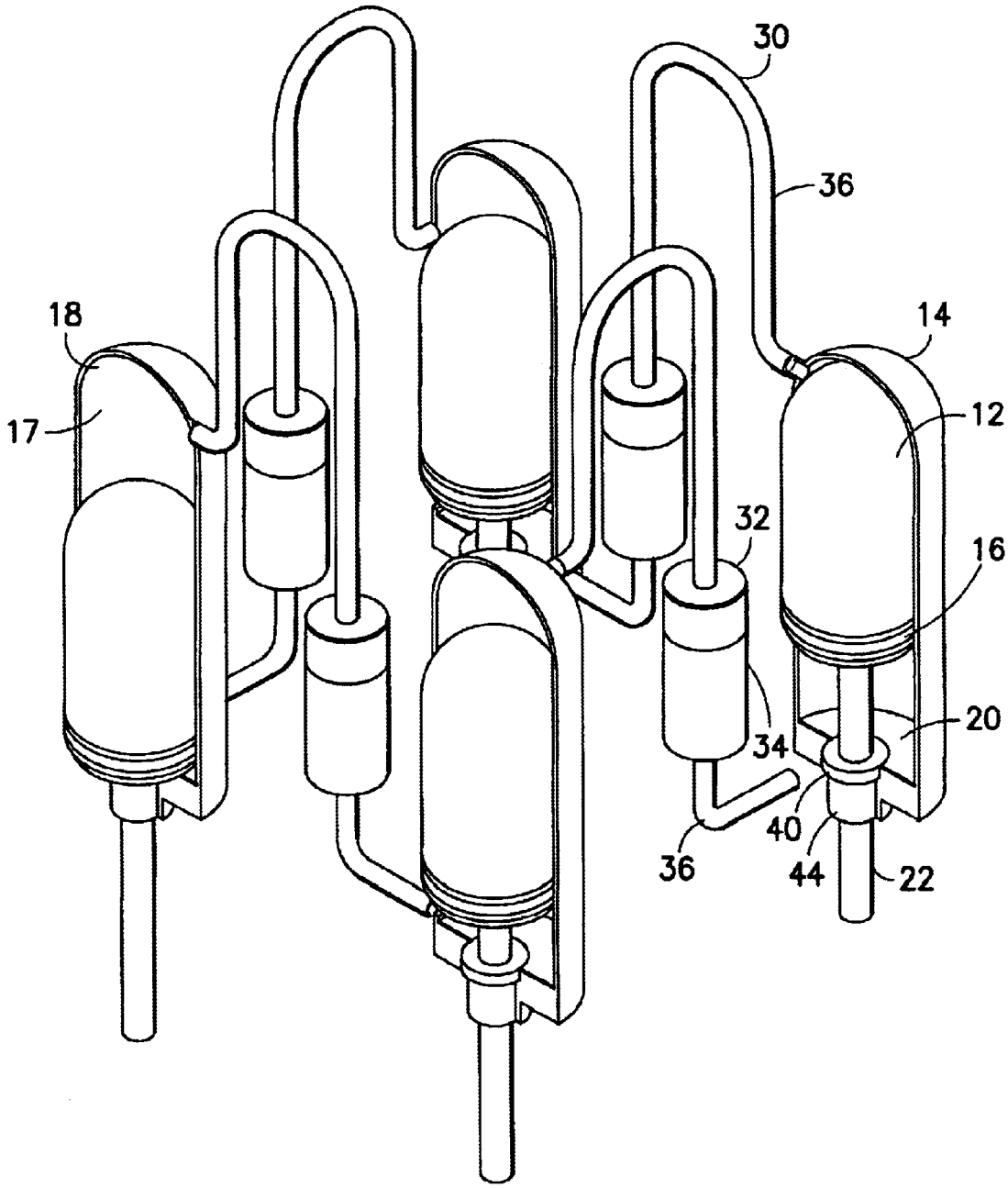
FIG. 2 is a partial section view of the pistons, cylinders, and heat exchange system of the Stirling engine of the invention.

Turning now to FIGS. 1 and 2, a first embodiment of a Siemens-type Stirling engine 10 is shown. The engine 10 has four pistons 12, each provided in a cylinder 14, and preferably displaced ninety degrees apart. Each piston 12 has a piston seal 16 that prevents passage of a working fluid 17 between a compression space 18 and an expansion space 20 within the cylinder 14. The pistons 12 are free to move axially in the cylinders 14 and control a cam drive mechanism, described below. While theoretically the engine 10 requires that the positions of the four pistons 12 be maintained in a ninety-degree phase relationship to each other with respect to a rotational axis $A_r$ of a cam 52 and an output shaft 24, in practice, other phase relationships can be used.

In a Siemens-Stirling engine 10, each cylinder 14 is connected to an adjacent cylinder by a heater 30, a regenerator 32, and a cooler 34 (FIG. 2). As the pistons 12 translate back and forth in the cylinders 14, the working fluid 17 is forced to flow in an oscillating fashion to and from the compression spaces 18 and expansion spaces 20 thru the heater 30, regenerator 32, cooler 34 and the connecting ducts 36.

Piston rod seals 40 isolate the preferably gaseous working fluid 17 from a gas space 42 in a preferably dry-sump crankcase 46. Linear piston rod bearings 44 support and locate the piston guide rods 22.

The output shaft 24 is supported in the crankcase 46 by three bearings 48. An output shaft seal 50 about the shaft 24 contains a preferably pressurized gaseous fluid 51 in the crankcase gas space 42. A cam 52 is rigidly attached to the output shaft 24. The cam 52 defines a preferably rectangular groove 54, with upper and lower surfaces 56, 58.

For each piston 12, a cam follower fitting assembly 60 is provided and includes a mount 68 supporting a cam follower 70 adapted to be inserted into the groove 54. The mount 68 of the assembly is attached to the lower end of each piston guide rod 22. A cam follower guide rod 72 is coupled to the bottom of the fitting assembly 60 coaxial with the piston rod 22 and rides in a linear bearing 73, and a cam follower alignment pin 74 is provided parallel to the follower guide rod 72. The follower guide rod 72 and alignment pin 74 reciprocate within mating bores 76, 78, respectively, as the piston 12 reciprocates. The follower alignment pin 74 maintains the correct position of the follower assembly 60 with respect to the cam 52 by preventing the follower assembly 60 from rotating about the common axis of the piston guide rod 22 and the follower guide rod 72 due to offset loads on the cam follower 70 which urges the follower 70 away from the cam 52.

Figure 3:
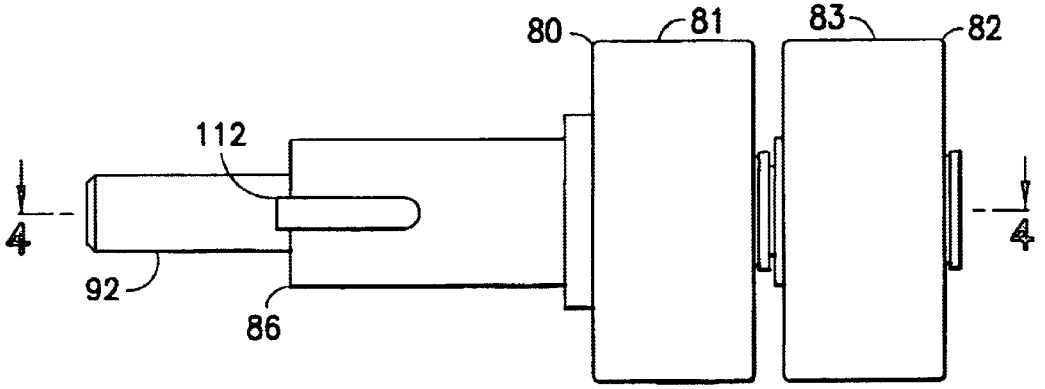
FIG. 3 is a plan elevation of a first embodiment of a cam follower according to the invention.
Figure 4:
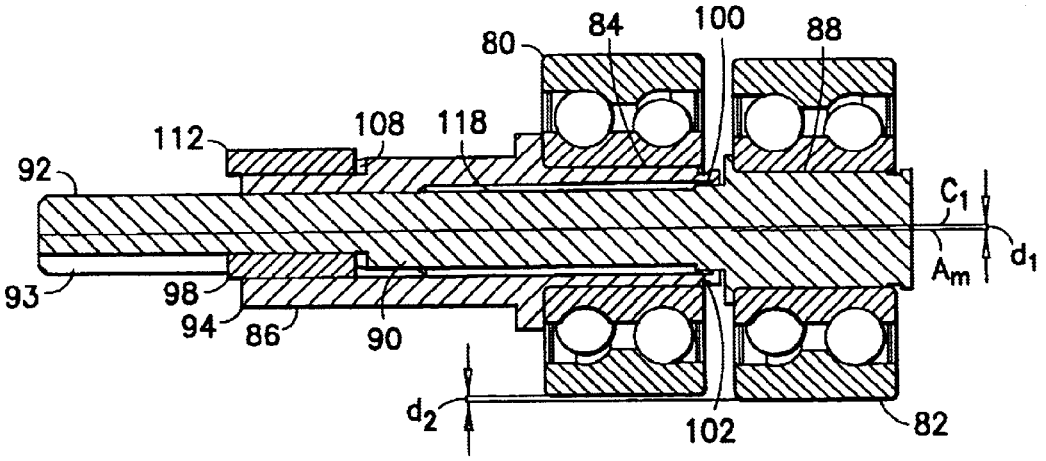
FIG. 4 is a section view along line 4—4 in FIG. 3.

Referring to FIGS. 3 and 4, a first embodiment of the cam follower 70 includes first and second longitudinally displaced ball bearings 80, 82 that are preferably of equal diameter. The bearings 80, 82 are preferably slightly crowned, i.e., have a spherically curved surface. While difficult to see due to the relatively large radius of curvature, this crowning is shown in the figures at 81 and 83. The crowning permits line contact between the bearings 80, 82 and respective inner surfaces 56, 58 of the cam groove 54, and thus reduces the effect of the difference in cam surface velocity at different radial distances from the output shaft rotational axis $A_r$. Moreover, the crowning prevents minor misalignments and deflections from causing binding.

The first bearing 80 is mounted on a cylindrical mount 84 of an outer shaft 86, and the second bearing 82 is mounted on a cylindrical mount 88 of an inner shaft 90 extending through the outer shaft 86. A centerline of the outer shaft 86 is concentric with a coupling end 92 of the inner shaft 90. An annular clearance gap 100, preferably equal all around, is provided between a raised section 102 of the inner shaft 90 and the inner surface of the outer shaft 86. The cylindrical mount 88 defines a rotational axis $A_m$ that is parallel to but offset by a distance $d_1$ from a centerline $C_1$ of the remainder of the inner shaft 90. Thus, the bearings 80, 82 are not rotationally concentric and the outer diameter of bearing 82 is offset from the outer diameter of bearing 80 by a distance $d_2$ that is equal to distance $d_1$.

The outer surface of the coupling end 92 the inner shaft 90 includes an outer key slot 93, and the inner surface of a coupling end 94 of the outer shaft 86 includes an inner key slot 96. An inner key 98 extends into the slots 93, 96 and rotationally locks the inner shaft 90 relative to the outer shaft 86.

Figure 5:
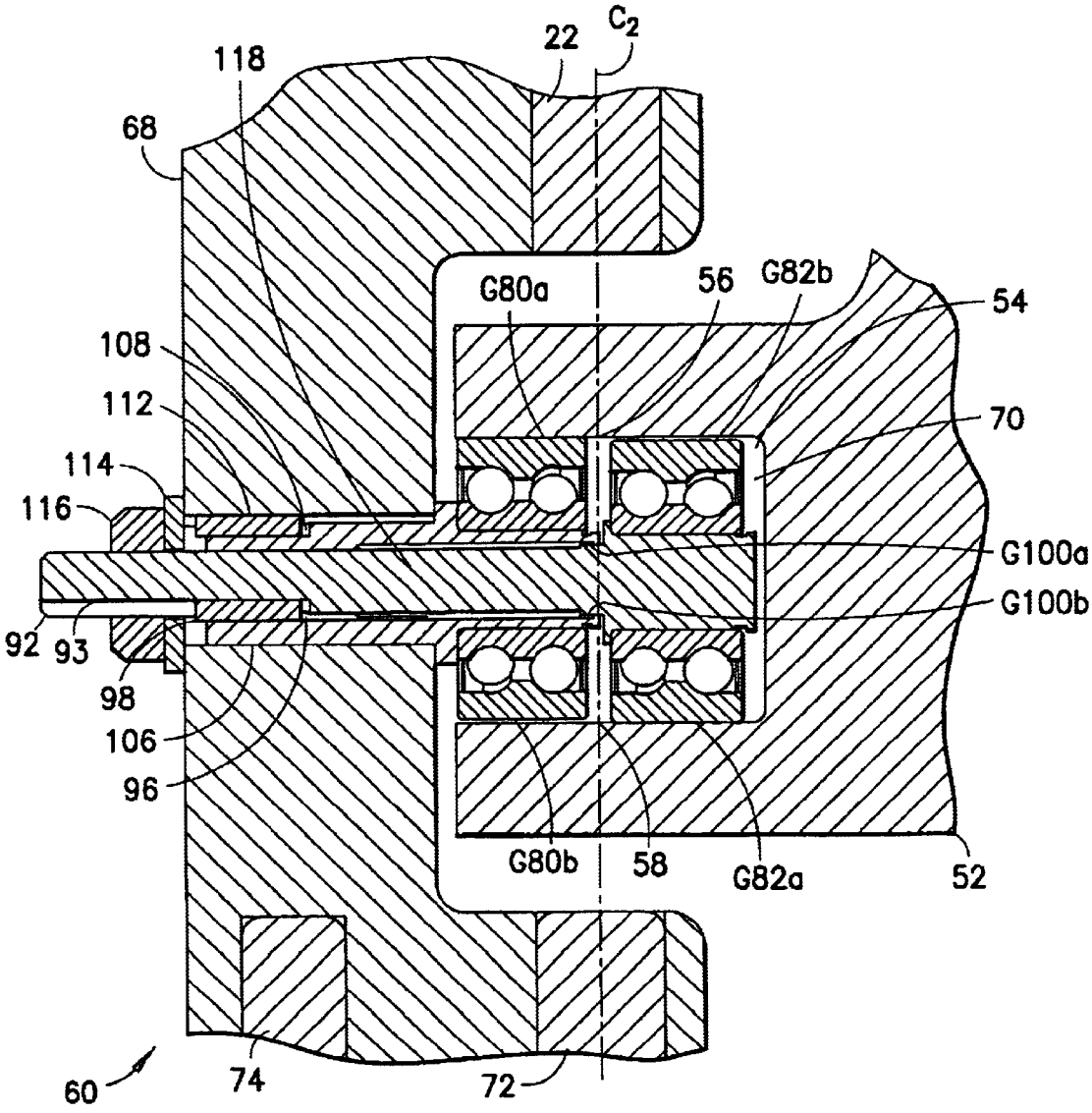
FIG. 5 is a broken section view of a portion of the cam drive system according to the invention.

Referring to FIG. 5, the follower 70 is coupled within a bore 106 of the mount 68 of the follower assembly 60. The outer surface of the coupling end 94 of the outer shaft 86 includes a outer key slot 108, and the mount bore 106 includes an inner key slot 110. An outer key 112 extends into the key slots 108, 110 and rotationally locks the outer shaft 86 within the bore 106. The coupling end 92 of the inner shaft 90 extends through the bore 106. The coupling end 92 is provided with threads (not shown), and a washer 114 and nut 116 are secured thereon to lock the follower 70 to the mount 68. The keys 98, 112 ensure that the follower is properly oriented in the mount 68 for the desired orientation of bearing offset $d_2$.

When the follower 70 is coupled to the mount 68, it is positioned for insertion into the cam groove 54. Once in the cam groove 54, the inner shaft 90 is cantilevered along a resilient beam portion 118 relative to outer shaft 86. That is, because the centerline $C_1$ of the follower 70 (FIG. 4) is held perpendicular to the rotational axis $A^r$ of the cam (FIG. 1) and by proper choice of the radial clearance gap 100 and the offset $d_2$, offset bearing 82 is forced against lower cam surface 58 and bearing 80 is forced against the upper cam surface 56. A portion of the distance $d_2$ and gap 100 is used up in bending the resilient portion 118 of inner shaft 90. This bending of the resilient portion beam 118 produces a preload that appears as a couple acting at contact points on the cam groove surfaces 56, 58. The couple is counteracted by an opposite couple created by forces from the piston guide rod 22 and cam follower guide rod 72 acting on linear bearings 44 and 73, respectively. The preloading eliminates excessive noise that would otherwise result and provides for extended bearing life, and more efficient operation.

In addition, the pistons 12, piston guide rods 22, cam follower mount 68, cam follower 70, cam follower guide rod 72, and cam follower alignment pin 74 comprise a rigid assembly that has a centerline $C_2$ passing through the center of the contact area of the cam follower 70; i.e., between the two bearings 80, 82. By locating the piston rod centerline $C_2$ through the center of the contact area of the cam follower 70, the moment about the piston rod centerline $C_2$ is reduced by providing the shortest moment arm from the piston rod centerline to any point of contact between the cam bearings 80, 82 and the cam surfaces 56, 58.

Referring to FIGS. 1 and 5, in operation, as each piston 12 is forced up and down by alternating pressure in the cylinder 14 (FIG. 2), the engagement of the bearings 80, 82 of the cam follower 70 with the cam surfaces 56 and 58 force the cam 52 and consequently the output shaft 24 to rotate about rotational axis $A_r$. The cam follower alignment pin 74 slides in its bore 78 in the crankcase 46 and prevents the cam follower assembly 60 from rotating about the axis defined by rods 22 and 72.

In view of the above arrangement for the cam drive mechanism, and assuming a preferred set of parameters in which:

i) the spring rate of the cantilevered beam portion 118 of the inner shaft 90 measured at the bearing-to-cam contact point equals 10,000 lbs/inch, ii) the cam groove width=bearing diameter+0.020 inch, and iii) the annular gap 100 between the raised section 102 of the inner shaft 90 and the outer shaft 86=0.020 inch, Table 1 sets forth various preferred exemplar contact forces created and gaps defined between identified elements during operation and otherwise.

TABLE 1

| | | Contact Forces and Gaps for Various Cam and Follower Configurations | | | | | | | | | |
|---|---|---|---|---|---|---|---|---|---|---|---|
| ID | Configuration | F80a | F82a | F80b | F82b | G80b | G82b | G82a | G80a | G100a | G100b |
| 1 | Prior to Insertion into Groove | 0 | 0 | 0 | 0 | — | — | — | — | 0.020 | 0.020 |
| 2 | Inserted into Groove | 100 | 100 | 0 | 0 | 0.020 | 0.020 | 0.000 | 0.000 | 0.010 | 0.030 |
| 3 | Piston Force Up = 100 | 200 | 100 | 0 | 0 | 0.020 | 0.020 | 0.000 | 0.000 | 0.010 | 0.030 |
| 4 | Piston Force | 1,100 | 100 | 0 | 0 | 0.020 | 0.020 | 0.000 | 0.000 | 0.010 | 0.030 |

TABLE 1-continued

| ID | Configuration | Contact Forces and Gaps for Various Cam and Follower Configurations | | | | | | | | | |
|---|---|---|---|---|---|---|---|---|---|---|---|
| | | F80a | F82a | F80b | F82b | G80b | G82b | G82a | G80a | G100a | G100b |
| | up = 1,000 | | | | | | | | | | |
| 5 | Piston Force | 0 | 200 | 0 | 0 | 0.010 | 0.020 | 0.000 | 0.010 | 0.000 | 0.040 |
| | Down = 100 | | | | | | | | | | |
| 6 | Piston Force | 0 | 1,100 | 0 | 0 | 0.010 | 0.020 | 0.000 | 0.010 | 0.000 | 0.040 |
| | Down = 1,000 | | | | | | | | | | |

In Table 1, F80*a* and F82*a* refer to forces at the surfaces of respective bearings 80, 82 which are in contact with respective cam surfaces 56, 58, and F80*b*, F82*b* refer to forces at a diametric location on bearings 80, 82, respectively. Referring to Table 1 and FIG. 5, G80*a* refers to the gap or space between bearing 80 and the upper cam surface 56, and G80*b* refers to the gap between bearing 80 and the lower cam surface 58. Likewise, G82*a* refers to the gap or space between bearing 82 and the lower cam surface 58, and G82*b* refers to the gap between bearing 82 and the upper cam surface 56. Finally, Referring to Table 1 and FIGS. 4 and 5, G100*a* refers to the gap space 100 between an upper side of the raised section 102 of the inner shaft 90 and the outer shaft 86, and G100*b* refers to the gap between a lower side of the raised section of the inner shaft and the outer shaft.

Therefore, as indicated at row ID1 of Table 1, prior to installation of the follower bearings 80, 82 into the groove 54, all contact forces equal 0 lbs. Moreover, gaps G80*a*, 80*b*, 82*a*, and 82*b* are undefined as there is no mating cam surface relative to which a measurement can be made. In addition, there is a uniform annular gap space at 100 between the inner and outer shafts, thereby making gaps G100*a* and G100*b* equal.

Once the follower is inserted into the groove (row ID2), the contact surfaces of each of the bearings 80, 82 is subject to a preloading force F80*a*, F82*a* of 100 lbs, while gaps G80*b* and G82*b* are 0.020 inch, as the cam groove is 0.020 inch wider than the bearing diameters. Gaps G80*a* and G82*a* are 0.000 inch, as these are now contact points. Gap G100*a* is reduced to 0.010 inch, while gap G100*b* is increased to 0.030 inch because the beam 118 is deflected upward by bearing 82 contacting cam surface 58.

Then, at row ID3, when an upward piston force of 100 lbs is added to the follower 70, forces F80*b* and F82*b* are 0, as there is no contact with the cam surfaces at the respective bearing surfaces. Force F82*a* remains at 100 lbs because the beam 118 has not deflected any more or less, while force F80*a* equals 200 lbs (the preload of 100 lbs plus the upward piston force of 100 lbs). Gaps G80*b* and G82*b* equal 0.020 inch because the bearings 80 and 82 both remain in contact with their respective bearing surfaces, and gaps G80*a* and G80*b* consequently remain at 0.000 inch. Gap G100*a* remains at 0.010 inch and G100*b* remains at 0.030 inch because there is no relative movement between the inner and outer shafts 86, 90.

At row ID4, the upward piston force is increased to 1000 lbs. The forces F80*b*, F82*b* remain at 0. Force F82*a* remains at 100 lbs because the deflection of the beam is not altered. Force F80*a* is now at 1100 lbs (the sum of the preload and the upward piston force). The gaps are all as discussed above in row ID3.

At row ID5, a 100 lbs downward force is applied to the piston 12, and hence the follower 70. Forces F80*b* and F82*b* remain at 0. Force F82*a* is 200 lbs (the sum of the preload and the piston force), while F80*a* is 0 because the beam 118 has been deflected by the added 100 lbs force. Gap G82*b* is 0.020 inch and gap G82*a* is 0.000 inch because bearing 82 is still in contact with the lower cam surface 56. Gaps G80*a* and G80*b* are each 0.010 inch because the beam has been deflected to a maximum extent. In addition, due to beam deflection, the annular space 100 is converted into a space that is not continuous about the inner shaft, as the inner shaft contacts the outer shaft (FIG. 5), making gap G100*a* equal to 0.000 and gap G100*b* equal to 0.040 inch.

Finally, at row ID6, the downward force is increased to 1000 lbs. The forces F80*b* and F82*b* remain at 0. Force F82*a* is at 1100 lbs, while force F80*a* remains at 0 lbs due to beam deflection. The gaps are all as discussed above with respect to row ID5.

As such, Table 1 shows that whenever the follower assembly 70 is installed into the groove 54, there is always a clearance gap at G80*b* and G82*b*, and forces F80*b* and F82*b* are always 0 lbs. Gap G82*a* is always 0.00 inch, and force F82*a* is always greater than 0; thus, bearing 82 is always preloaded. There is a condition when the piston force is downward that force F80*a* equals 0 lb and gap G80*b* equals 0.010 inch. At this time bearing 80 is not preloaded, but this is only for a portion of the cam revolution. Importantly, both bearings 80, 82 revolve in the same direction continuously.

The inner shaft 90, outer shaft 86, and mating components are easily manufactured, comprise a more compact, lightweight assembly, and should be less expensive than the followers required for bladed cam mechanisms. Moreover, the forces on the follower and associated moving components can be kept to acceptable levels, reducing wear, spalling, and friction on the followers and cam surfaces in contact with the followers.

Figure 6:
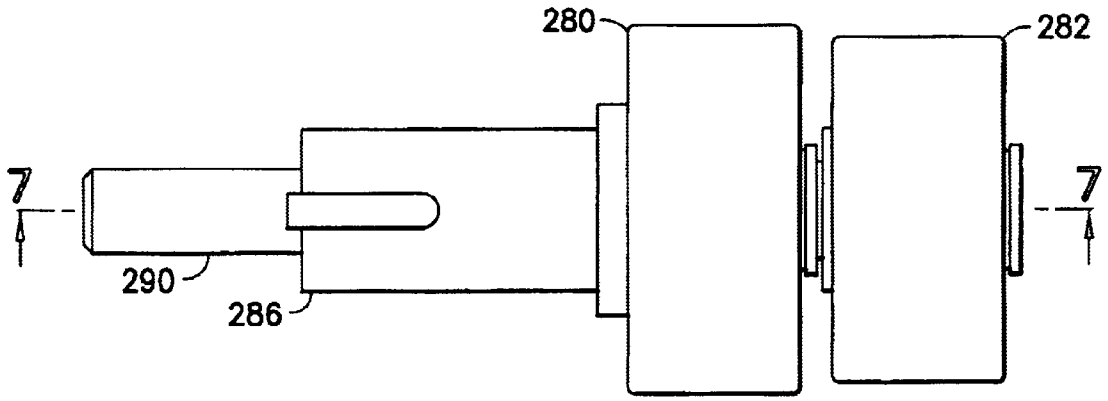
FIG. 6 is a plan elevation of a second embodiment of a cam follower according to the invention.
Figure 7:
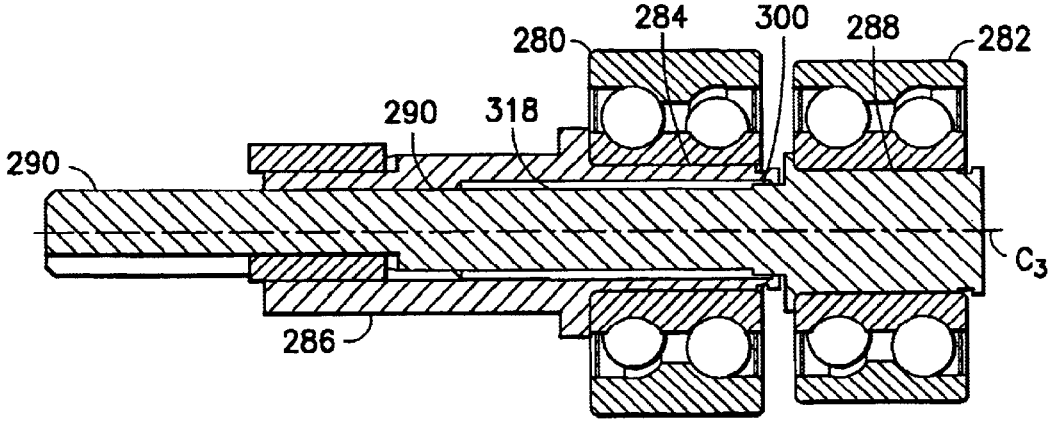
FIG. 7 is a section view along line 7—7 in FIG. 6.

Turning now to FIGS. 6 and 7, a second embodiment of a cam follower 270, substantially similar to the first embodiment, (with like elements having reference numerals incremented by 200 relative to cam follower 70) is shown. The cam follower 270 includes two inline bearings 280, 282. Bearing 280 is mounting on a bearing mount 284 at an end of outer shaft 286, while bearing 282 is mounted on a bearing mount 288 at an end of inner shaft 290. Bearing 282 is smaller in diameter than bearing 280. Unlike inner shaft 90, all cylindrical surfaces on inner shaft 290 are concentric and thus the bearings 280 and 282 are concentric about centerline $C_3$ in the free unloaded state. As such, annular gap 100 is equal all around.

Figure 8:
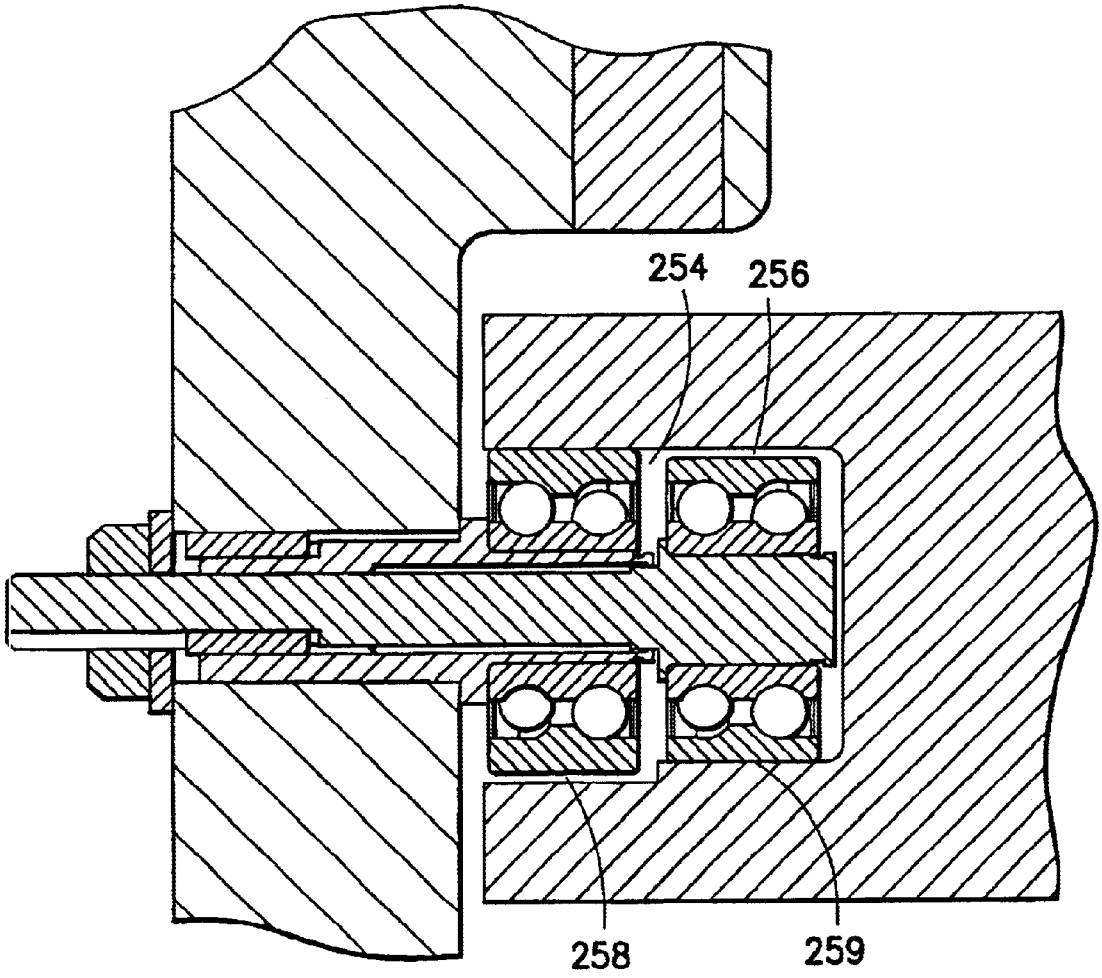
FIG. 8 is a broken section view of a portion of a second embodiment of the cam drive system according to the invention, shown having a stepped rectangular groove and the second embodiment of the cam follower.

Referring to FIG. 8, the cam groove 254 includes a step 259, e.g., on the lower cam surface 258. The distance between cam surfaces 256, 258, the height of step 259, and the diameters of bearings 280 and 282 determine the preload when installed. More particularly, step 259 forces bearing 282 out of concentricity with bearing 280. The cantilever beam section 318 (FIG. 7) of inner shaft 290 is thereby bent, thus producing a preload.

Figure 9:
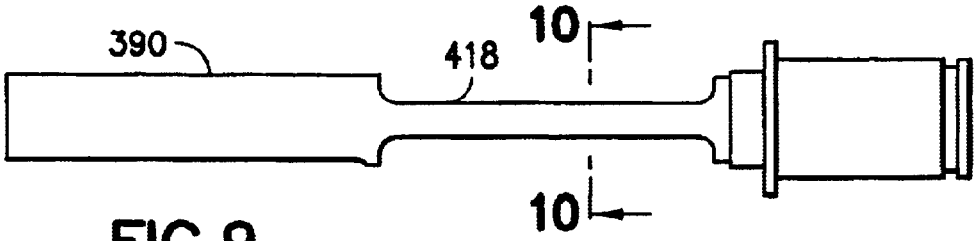
FIG. 9 is a side elevation of an alternative inner shaft for the cam follower of the invention.
Figure 10:
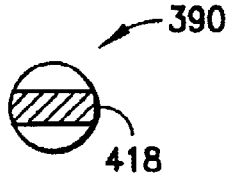
FIG. 10 is a section view across line 10—10 in FIG. 9.

Turning now to FIG. 9, an alternate inner shaft 390 is shown which may be substituted for inner shafts 90 and 290 where a lower spring rate of a cantilever beam section 418 may be desired. Portions of the cantilever beam section 418 are removed to reduce the cross-sectional area of the section (FIG. 10). This results in a beam that is relatively stiffer in one direction than the other so that deflections in different directions can be controlled.

Figure 11:
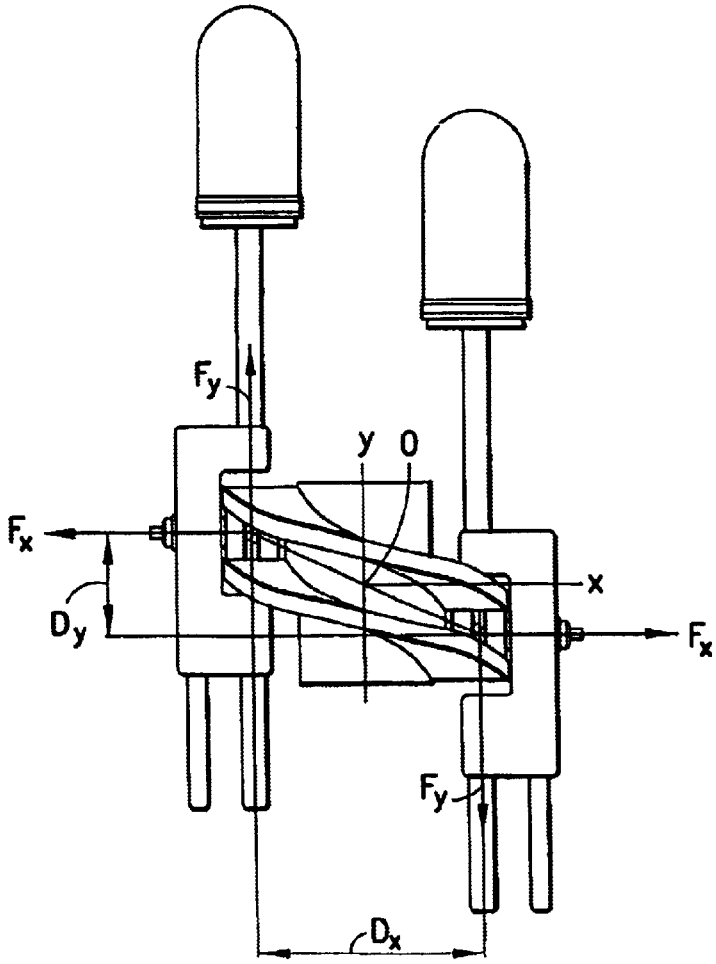
FIG. 11 illustrates the dynamic balancing of the cam drive mechanism of the invention.

Referring now to FIG. 11, the dynamic balancing of the cam drive mechanism is shown. The rotating cam with its asymmetric mass distribution creates a couple $D_y \times F_x$ about the origin O of the x-y coordinate system shown. The moving piston/follower masses create the opposite couple $D_y \times F_y$. By correct choice of masses and separation distances, the opposite couples can be made equal and to cancel each other thus dynamically balancing the mechanism.

Figure 13:
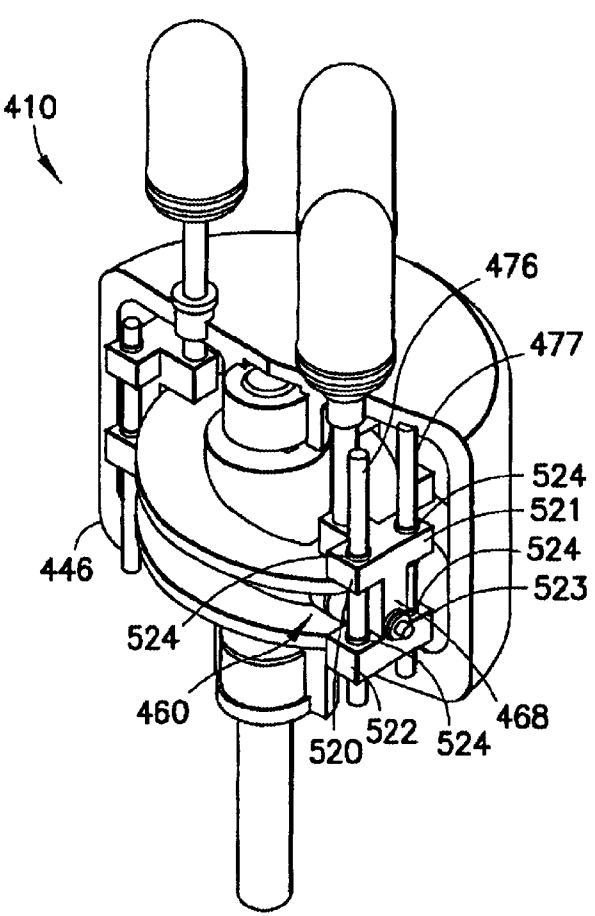
FIG. 13 is a partial cutaway perspective view of the Stirling engine of FIG. 12.
Figure 12:
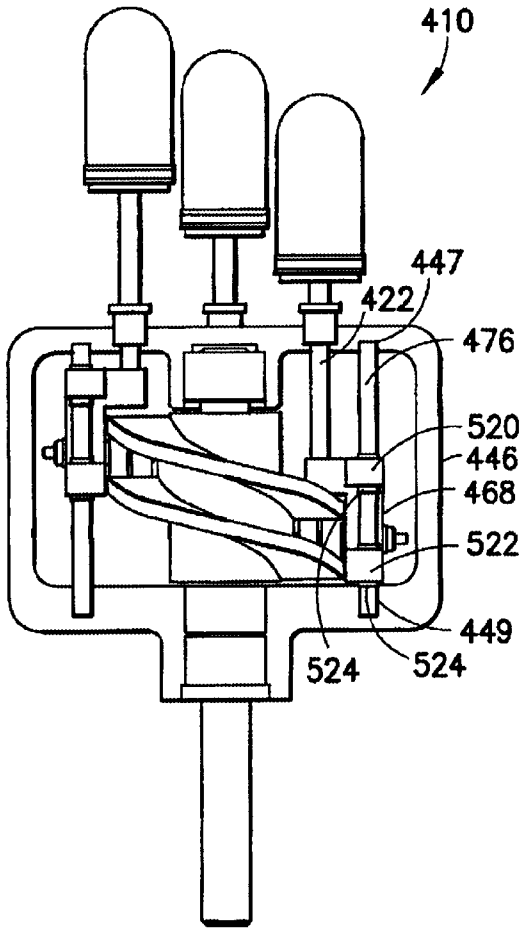
FIG. 12 is a partial cutaway of a second embodiment of a Stirling engine according to the invention.

Turning now to FIGS. 12 and 13, a second embodiment of a Stirling engine 410, substantially similar to the first embodiment (with like elements having reference numerals incremented by 400), is shown. The engine 410 includes a dual guide rod design for the cam follower assembly. More particularly, first and second guide rods 476, 477 are spaced apart and rigidly attached to the upper and lower portions 447, 449 of the crankcase 446. The guide rods 476, 477 extend parallel to the piston rod 422. The mount 468 of the cam follower assembly 460 includes upper ears 520, 521 and lower ears 522, 523, each defining a bore provided with a bearing 524. Guide rod 476 extends through bearings 524 in ears 520, 522, and guide rod 477 extends through bearings 524 in ears 521, 523. This design provides more rigid guidance to the follower assembly 460 (relative to the single guide rod 76 of the first embodiment). Moreover, this cam follower assembly is significantly shorter than the first embodiment, thereby permitting the overall height of the crankcase 446 to be reduced. Compare the height of crankcase 46 (FIG. 1) with the height of crankcase 446. Thus, weight and size reduction result.

There have been described and illustrated herein several embodiments of a Stirling engine and cam drive mechanism suitable for a Stirling engine. While particular embodiments of the invention have been described, it is not intended that the invention be limited thereto, as it is intended that the invention be as broad in scope as the art will allow and that the specification be read likewise. Thus, while ball bearings have been disclosed for use with the follower, it will be appreciated that other bearings, such as roller and needle bearings, can be used as well. In addition, while a preload of approximately 100 lbs (e.g., 75 lbs to 125 lbs) is preferred, it is recognized that the system can be designed to subject the bearings to other preload forces. Also, where particular gap dimensions have been provided, it is understood that other gap dimensions can be used. Furthermore, while a Siemens-type engine with four pistons/cylinders has been shown, it is understood that other types of Stirling engines with other numbers of pistons and cylinders can be used. Moreover, additional piston sets can be added by adding more grooves displaced axially along the output shaft. Additional piston sets can also operate in the same groove and face axially in the same direction as the original pistons or face in the opposite direction. For example, eight pistons can operate in one groove and maintain a ninety degree phase relationship by using a groove with two cycles per revolution instead of one cycle as shown in FIG. 1. Also, it is appreciated that the engine can be used as a refrigerator or heat pump, in which rotation of the shaft 54 with attached cam 52 causes the followers 70 to move in the cam groove 54 in a manner that causes the pistons 12 to translate within their respective cylinders 14. Furthermore, while the preferred description has included pistons within the cylinders, it is understood that bellows, diaphragms, and other mechanisms can be used, and for purposes of simplicity, the term 'piston' should be read to include bellows, diaphragms, and such other mechanisms, particularly with respect to the claims. It will therefore be appreciated by those skilled in the art that yet other modifications could be made to the provided invention without deviating from its spirit and scope as claimed.

What is claimed is:

1. A Stirling engine, comprising:

a) a pressure vessel containing a working fluid;

b) a first heat exchanger means for heating said working fluid;

c) a second heat exchanger means for cooling said working fluid;

d) a regenerator for storing heat energy released by the working fluid; and e) a piston movable within the pressure vessel;

f) a cam follower coupled to said piston, said cam follower including first and second longitudinally displaced bearings; and g) a rotatable shaft having a cam groove circumferentially thereabout, said cam groove includes first and second inner surfaces, wherein said first bearing contacts one of said first and second inner surfaces and a first clearance space is provided between said first bearing and said other of said first and second inner surfaces, and said second bearing contacts the other of said first and second inner surfaces and a second clearance space is provided between said second bearing and said one of said first and second inner surfaces.

2. A Stirling engine according to claim 1, wherein:

said first and second bearings each have a crowned bearing surface.

3. A Stirling engine according to claim 1, wherein:

said follower includes an outer shaft having a first mount on which said first bearing is mounted, and an inner shaft extending through said first shaft and having a second mount on which said second bearing is mounting.

4. A Stirling engine according to claim 3, wherein:

a space is defined between a portion of said inner shaft and said outer shaft, said inner shaft being sufficiently resilient to bend within said space relative to said outer shaft when subject to a predetermined load.

5. A Stirling engine according to claim 3, wherein:

in an unloaded state, said first and second mounts are offset by a first distance such that said first and second bearings have non-concentric rotational axes.

6. A Stirling engine according to claim 5, wherein:

when said first and second bearings are subject to a load, said first and second mounts are offset by a second distance smaller than said first distance.

7. A Stirling engine according to claim 2, wherein:

said first bearing is larger in diameter than said second bearing, and in an unloaded state, said first and second bearings have axes of rotation which are concentric.

8. A Stirling engine according to claim 7, wherein:

when said first and second bearings are subject to a load, said first and second mounts are offset such that said axes of rotation are non-concentric.

9. A Stirling engine according to claim 8, wherein:

one of said first and second inner surfaces of said cam groove is stepped.

10. A Stirling engine according to claim 1, wherein:

said first and second bearings are preloaded against the inner surfaces of said cam groove with which each is in contact.

11. A Stirling engine according to claim 10, wherein:

said preload is 75 to 125 lbs.

12. A Stirling engine according to claim 10, wherein:

said preload is at least 100 lbs.

13. A Stirling engine according to claim 1, wherein:

when said cam follower is moved relative to said cam groove, said first bearing rotates in a first direction only, and said second bearing rotates in a second direction only, opposite said first direction.

14. A Stirling engine, comprising:

a) a pressure vessel containing a working fluid;

b) a first heat exchanger means for heating said working fluid;

c) a second heat exchanger means for cooling said working fluid;

d) a regenerator for storing heat energy released by the working fluid;

e) a rotatable shaft having a cam groove circumferentially thereabout and defining first and second inner surfaces;

f) a piston movable within the pressure vessel; and g) a cam follower coupled to said piston, said cam follower preloaded against both said first and second inner surfaces of said cam groove.

15. A Stirling engine according to claim 14, wherein:

said follower includes first and second longitudinally displaced bearings.

16. A Stirling engine according to claim 14, wherein:

said first and second bearings have non-concentric rotational axes under said preload.

17. A Stirling engine according to claim 1, further comprising:

h) a crankcase;

i) a piston rod having first and second ends, said first end coupled to said piston and said second end extending into said crankcase;

j) a follower mount within said crankcase and coupled to said piston rod, wherein said cam follower is rigidly coupled to said follower mount; and k) a pair of guide rods coupled within said crankcase and extending through said follower mount, said follower mount slidable relative to said guide rods.

18. A Stirling engine, comprising:

a) a pressure vessel containing a working fluid;

b) a first heat exchanger means for heating said working fluid;

c) a second heat exchanger means for cooling said working fluid;

d) a regenerator for storing heat energy released by the working fluid;

e) a rotatable shaft having a cam groove circumferentially thereabout and defining first and second inner surfaces;

f) a piston movable within the pressure vessel along an axis; and g) a cam follower coupled to said piston, said cam follower including first and second longitudinally displaced bearings defining a center line therebetween, said center line aligned along said axis.

19. A Stirling engine, comprising:

a) a pressure vessel containing a working fluid;

b) a first heat exchanger means for heating said working fluid;

c) a second heat exchanger means for cooling said working fluid;

d) a regenerator for storing heat energy released by the working fluid;

e) a rotatable shaft having a cam groove circumferentially thereabout and defining first and second inner surfaces;

f) a piston movable within the pressure vessel; and g) a cam follower coupled to said piston, said cam follower including i) an outer shaft having a first mount at an end, ii) an inner shaft extending through said first shaft and having a second mount at an end, iii) a first bearing mounted on said first mount, and iv) a second bearing mounted on said second mount, said inner and outer shafts defining a space between a portion of said inner shaft and said outer shaft, said inner shaft having a beam portion being sufficiently resilient to bend within said space relative to said outer shaft when subject to a predetermined load.

20. A Stirling engine according to claim 19, wherein:

said beam portion of said inner shaft has a non-circular cross-sectional shape.

21. A cam follower for use against at least one camming surface, said cam follower comprising:

a) an outer shaft having a first mount at an end;

b) an inner shaft extending through said first shaft and having a second mount at an end, a space being defined between a portion of said inner shaft and said outer shaft, said inner shaft having a beam portion sufficiently resilient to bend within said space relative to said outer shaft when subject to a predetermined load;

c) a first bearing mounted on said first mount; and d) a second bearing mounted on said second mount.

22. A cam follower according to claim 21, wherein:

said first and second bearings have respective axes of rotation which are concentric in an unloaded state, and non-concentric in a loaded state in which said first bearing is contacted against a first camming surface and said second bearing is contact against a second camming surface opposite said first camming surface.

23. A cam follower according to claim 21, wherein:

said first and second bearings have respective axes of rotation which are non-concentric and offset by a first distance in an unloaded state, and non-concentric and offset by a second distance smaller than said first distance in a loaded state in which said first bearing is contacted against a first camming surface and said second bearing is contact against a second camming surface opposite said first camming surface.

24. A cam follower according to claim 21, wherein:

said beam portion has a non-circular cross-sectional shape.

* * * * *

UNITED STATES PATENT AND TRADEMARK OFFICE

CERTIFICATE OF CORRECTION

PATENT NO. : 6,701,709 B2
DATED : March 9, 2004
INVENTOR(S) : Donald Issac, Jr. et al.

It is certified that error appears in the above-identified patent and that said Letters Patent is hereby corrected as shown below:

Title page,
Item [73], Assignee, should read -- Mandi Company, Half Moon Bay, CA (US) --

Signed and Sealed this

Twenty-fifth Day of May, 2004

JON W. DUDAS
*Acting Director of the United States Patent and Trademark Office*